US005249799A

United States Patent [19]

Chang

[11] Patent Number: 5,249,799

[45] Date of Patent: Oct. 5, 1993

[54] RACKET INCLUDING A METAL REINFORCED THROAT SECTION

[76] Inventor: Chen-Chung Chang, No. 912, Chung-Shan Rd., Shen-Kang Hsiang, Taichung Hsien, Taiwan

[21] Appl. No.: 918,094

[22] Filed: Jul. 24, 1992

[51] Int. Cl.[5] ..... A63B 49/06; A63B 49/12

[52] U.S. Cl. ..... 273/73 G; 273/73 H; 273/73 K

[58] Field of Search ..... 273/73 R, 73 C, 73 G, 273/73 H, 73 K

[56] References Cited

U.S. PATENT DOCUMENTS

| | | | |
|---|---|---|---|
| D. 257,163 | 9/1980 | Lo | 273/73 C X |
| 2,224,567 | 12/1940 | Reach | 273/73 C |
| 3,664,669 | 5/1972 | Latham et al. | 273/73 G X |
| 4,066,260 | 1/1978 | Rodgers, Jr. | 273/73 C |
| 4,119,313 | 10/1978 | Popplewell et al. | 273/73 G X |
| 4,423,869 | 1/1984 | Haines | 273/73 C |
| 4,618,148 | 10/1986 | Mortvedt et al. | 273/73 C |
| 4,913,434 | 4/1990 | Fischer | 273/73 C |

FOREIGN PATENT DOCUMENTS

| | | | |
|---|---|---|---|
| 0162109 | 11/1954 | Australia | 273/73 K |
| 1168573 | 12/1958 | France | 273/73 K |
| 0616849 | 4/1980 | Switzerland | 273/73 G |
| 0858169 | 1/1961 | United Kingdom | 273/73 G |

*Primary Examiner*—William Stoll

*Attorney, Agent, or Firm*—Lowe, Price, LeBlanc & Becker

[57] ABSTRACT

An improved racket includes a metal frame having a throat section and two curved portions extending in the throat section and converging to a point where the throat section connects the handle section; a metal throat piece bridging and fastened to the curved portions above the point and having two reinforcing longitudinal side flanges to form a substantially U-shaped cross-section, the metal throat piece further having two curved ends bending to abut the parts of the curved portions where the metal throat piece is attached; and a covering layer formed by injecting a plastic composite material around the metal frame and the metal throat piece.

4 Claims, 4 Drawing Sheets

RACKET INCLUDING A METAL REINFORCED THROAT SECTION

BACKGROUND OF THE INVENTION

1. Field of The Invention

The present invention relates to an improved racket, more particularly to a metal racket having a metal throat piece bridging and fastened to the throat section thereof to achieve reinforcement of the strength of the racket frame.

2. Brief Description of The Prior Art

As shown in FIG. 1, most conventional metal rackets have been made by using a metal tube, usually of an aluminum alloy, bent to form a racket frame. The racket frame generally has a looped section (A), a throat section (B), and a neck section (C) retained in a handle (D). There is a throat bridge (E) usually made of a plastic material, which bridges and is fastened to the throat section (B) of the frame by screws (1) such that a string web (F) can be stretched in the space formed by the looped section (A) of the frame and the plastic throat piece (E).

Generally, the strength of such plastic throat bridge (E) is not comparable with and is far weaker than that of the racket frame which is made of a metal tube. Also, the plastic throat bridge (E) will very likely be deformed or even damaged under pressure. These factors can cause the fastening between the plastic throat bridge (E) and the metal racket frame to become loose. Also, because of the weak strength of the plastic throat piece (E), when a string web (F) is stretched in the frame or when the threads of the string web (F) are is adjusted, the tension of the threads may also damage the plastic bridge (E). Thus, the conventional racket has room for improvement in regard to its manufacture and for eliminating defects known to arise in its use.

SUMMARY OF THE INVENTION

As can be realized from the foregoing description, much improvement is possible in making a racket. Therefore, it is a principal object of this invention to provide a metal racket which has a metal frame, bridged and fastened by a metal throat piece, and a covering layer of a plastic composite material formed around the metal racket frame and the throat piece by injection molding so as to improve the strength of the racket frame.

Accordingly, a racket according to a preferred embodiment of the present invention comprises:

a metal frame having a looped section, a throat section and a handle section, the metal frame having two curved portions extending in the throat section and converging to a point where the throat section connects to the handle section;

a metal throat piece bridging and fastened to the curved portions above the point and having a central strip and two reinforcing longitudinal side flanges formed along opposing edges of the central strip to form a substantially U-shaped cross-section, the metal throat piece further having two curved ends bending to abut adjacent portions of the curved portions where the metal throat piece is attached; and formed by injecting a plastic composite material around the metal frame and the metal threat piece to form a continuous layer thereabout.

BRIEF DESCRIPTION OF THE DRAWINGS

Other related objects, aspects and advantages of the present invention can be fully understood from the following detailed description of the preferred embodiment of the present invention, taken with the accompanying drawing, wherein.

DETAILED DESCRIPTION OF THE INVENTION

Figure 1:
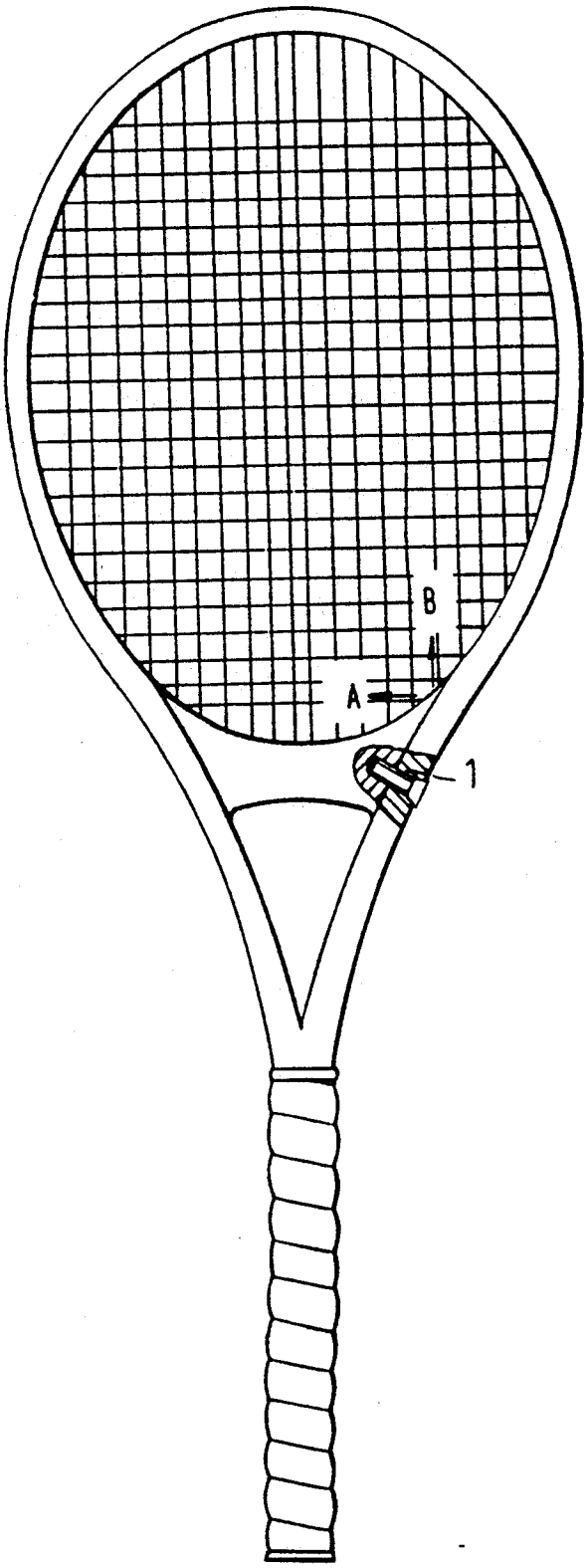
FIG. 1 PRIOR ART
FIG. 1 illustrates a conventional racket.
Figure 2:
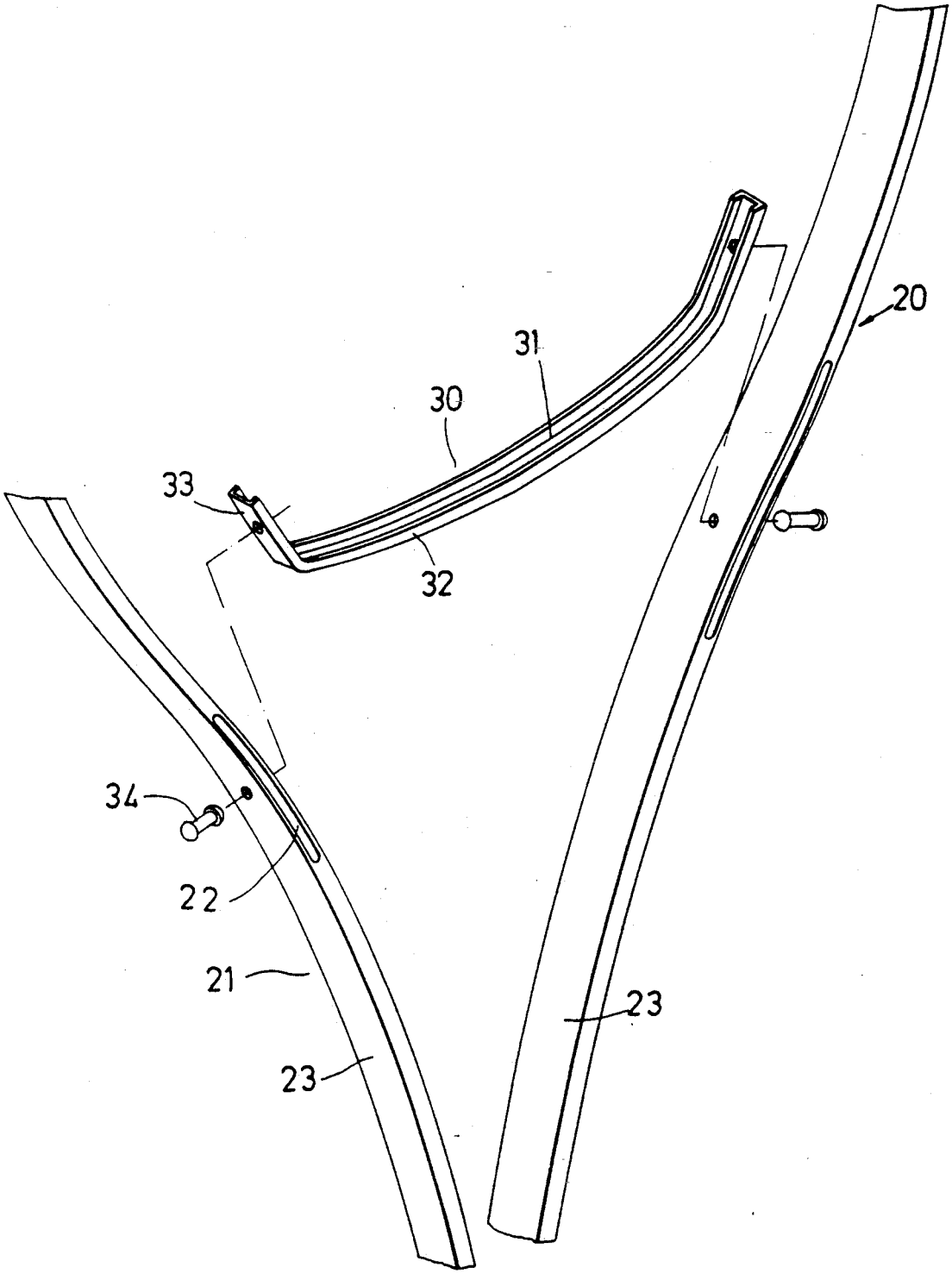
FIG. 2 is a fragmental exploded view of a preferred embodiment of the present invention, showing a metal throat piece and a throat section of a metal frame.
Figure 3:
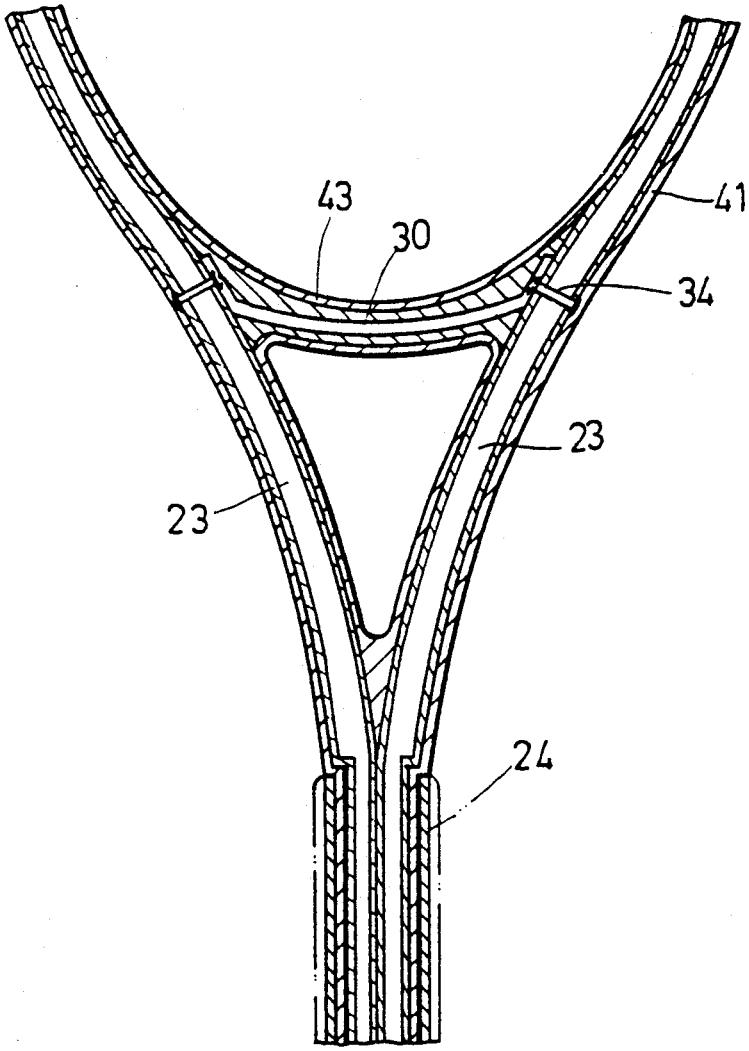
FIG. 3 is a fragmental plan view of the throat section of the embodiment of the present invention, showing the metal throat piece bridging and fastened to the throat section of the metal frame.
Figure 4:
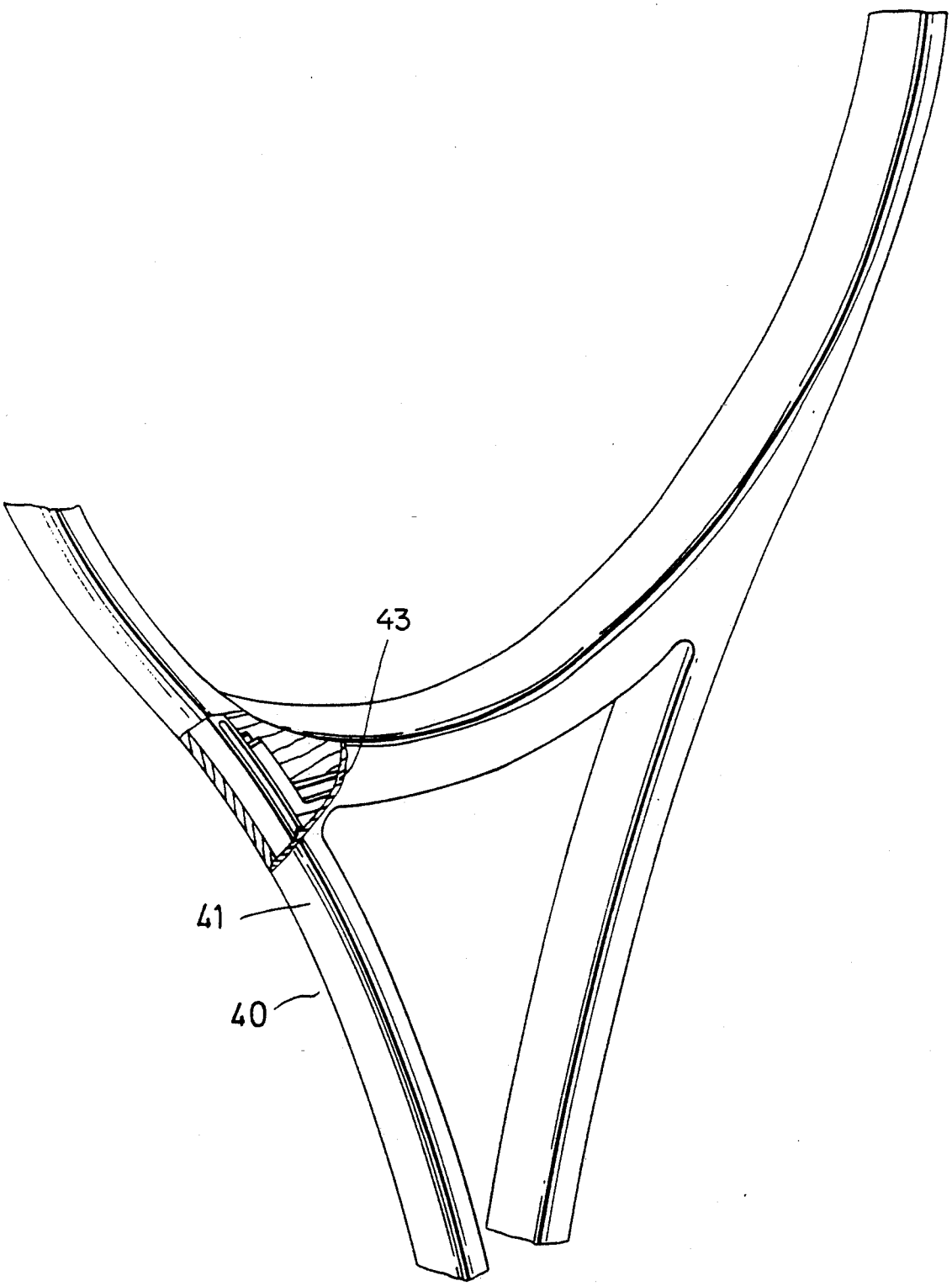
FIG. 4 is a fragmental perspective view of the throat section of the embodiment of the invention, showing a covering layer of a plastic composite material injected integrally to cover the metal frame and the metal throat piece.

A preferred embodiment of a racket of the invention, as best seen in FIGS. 2, 3 and 4, comprises a metal frame (20), a metal throat piece (30) and a covering layer (40) comprising a plastic composite material.

The metal frame is formed of a metal tube bent to form a looped section, a throat section (21) and a handle section (24). The throat section (21) has two curved portions (23) converging to connect to the handle section (24). Each of the curved portions (23) is preferably provided with an engaging elongate through-hole (22) formed therein as best seen in FIGS. 2 and 4.

The metal throat piece (30) includes a plate (31) having two reinforcing longitudinal side flanges (32) to form a substantially U-shaped cross-section. The metal throat piece (30) further comprises two curved ends (33) abut to the parts of the curved portions (23) where the metal throat piece (30) is attached. The metal throat piece (30) bridges the curved portions (23) and its ends (33) are fastened to the curved portions (23), by using two bolts (34), above the point where the two curved portions (23) converge and connect to the handle section (24).

The covering layer (40) can be formed by placing the metal frame and the throat piece in a known mold cavity and by injecting, via a known injection molding machine, a plastic molding composition into the mold cavity. The plastic molding composition may include a composite material containing short fibers. The covering layer (40) includes a first layer portion (41) of a slected thickness which surrounds the racket frame (20) and extends into a part of the handle section (24). See FIG. 3. The covering layer portion (41) also fills the engaging elongate through-hole (22) of each of the curved portions (23) thereby increasing the binding effect between the covering layer (40) and the metal frame (20). Further, the covering layer (40) has an extended layer portion (43) which covers the plate (31), the reinforcing side flanges (32) and the curved ends (33) of metal throat piece 30. Since the covering layer (40) is thus bonded integrally to both the metal frame (20) and the metal throat piece (30), the strength of the joints between the metal frame (20) and the metal throat piece (30) is increased.

The racket of the present invention has several advantages which make it superior to the conventional racket.

First, the frame and the throat piece are both made of metal. Thus, the frame and the throat piece have similar strength and the connection between them will be much stronger than in the prior art which uses only a plastic throat piece. Moreover, the metal throat piece (30) is provided with two side reinforcing flanges (32), thereby reinforcing the throat piece (30) and increasing its ability to exert a bearing force against the tension force of the strings.

Second, the plastic covering layer fills the engaging elongate through-holes (22) and can thus retain the structure of the throat portion of the racket more firmly as compared with the conventional racket.

The embodiment described above is only for the purpose of illustrating the present invention and should not be deemed to limit the scope of the invention.

What is claimed is:

1. A racket, comprising:

a metal frame having a looped section, a throat section and a handle section, said metal frame having two curved portions extending in said throat section and converging to a point where said throat section connects to said handle section;

a metal throat piece bridging and fastened to said curved portions above said point and having a central strip and two reinforcing longitudinal side flanges formed along opposing edges of said central strip to form a substantially U-shaped cross-section, said metal throat piece further having two curved ends bending to abut adjacent portions of said curved portions where said metal throat piece is attached; and a covering layer formed by injecting a plastic composite material around said metal frame and said metal throat piece to form a contiguous layer thereabout.

2. A racket as claimed in claim 1, wherein:

said curved portions are each formed to have a respective aperture formed transversely therethrough adjacent to said throat piece, said composite material filling said apertures of said curved portions and thereby enhancing effective binding between said covering layer and said metal frame near said throat piece.

3. A racket, comprising:

a metal frame including an upper loop, an end portion of said upper loop extending into opposing curved portions and converging together to form a throat section;

a handle portion connected to said throat section;

a metal throat reinforcing piece bridging and fastened to said curved portions, said metal throat reinforcing piece having an elongate central portion with opposing reinforcing longitudinal side flanges to form a substantially U-shaped cross-section; and a contiguous plastic covering formed on said metal frame and metal throat.

4. The racket according to claim 3, further comprising:

elongate slots formed through said curved portions perpendicular to a plane of said loop, said slots being formed along longitudinal lengths of said curved portions;

apertures formed in said curved portions and said throat reinforcing piece in a plane of said loop perpendicular to and passing through portions of respective ones of said slots; and a pair of fasteners mounted in said apertures mounting said throat reinforcing piece to said curved portions.

* * * * *